US011697140B2

(12) United States Patent
Luckey et al.

(10) Patent No.: US 11,697,140 B2
(45) Date of Patent: Jul. 11, 2023

(54) TOOL CLEANING APPARATUS

(71) Applicant: Honda Motor Co., Ltd., Tokyo (JP)

(72) Inventors: Jasmeen Luckey, Pell City, AL (US); Rodney Riley, Birmingham, AL (US)

(73) Assignee: Honda Motor Co., Ltd., Tokyo (JP)

( * ) Notice: Subject to any disclaimer, the term of this patent is extended or adjusted under 35 U.S.C. 154(b) by 385 days.

(21) Appl. No.: 16/710,242

(22) Filed: Dec. 11, 2019

(65) Prior Publication Data

US 2021/0178435 A1 Jun. 17, 2021

(51) Int. Cl.

| | |
|---|---|
| ***B08B 9/032*** | (2006.01) |
| ***B08B 13/00*** | (2006.01) |
| ***B08B 5/02*** | (2006.01) |
| ***B08B 3/02*** | (2006.01) |
| ***B08B 9/00*** | (2006.01) |

(52) U.S. Cl.

CPC ..... *B08B 13/00* (2013.01); *B08B 3/02* (2013.01); *B08B 5/02* (2013.01); *B08B 9/00* (2013.01); *B08B 9/0325* (2013.01); *B08B 2209/00* (2013.01)

(58) Field of Classification Search

CPC ..... B08B 9/032; B08B 9/0321; B08B 9/0325; B08B 9/20; B08B 9/28; B08B 9/283; B08B 9/34; B08B 2209/032

See application file for complete search history.

(56) References Cited

U.S. PATENT DOCUMENTS

2008/0308127 A1* 12/2008 Padtberg ..... A47L 15/0057 134/18
2012/0211028 A1* 8/2012 Bigott ..... B08B 9/20 134/18
2012/0312329 A1* 12/2012 David ..... B08B 9/00 34/523
2017/0113314 A1* 4/2017 Murota ..... B25J 19/021
2019/0143534 A1 5/2019 Watanabe et al.
2020/0398301 A1* 12/2020 Duan ..... B05B 15/557

FOREIGN PATENT DOCUMENTS

| | | | | |
|---|---|---|---|---|
| CN | 106113075 B | | 3/2018 | |
| CN | 108212617 A | * | 6/2018 | ..... B05B 15/55 |
| CN | 108481358 A | | 9/2018 | |
| CN | 107717784 B | | 8/2019 | |
| JP | 2002046075 A | | 2/2002 | |
| JP | 4629765 B2 | | 2/2011 | |
| KR | 200145210 Y1 | | 6/1999 | |

* cited by examiner

*Primary Examiner* — Marc Lorenzi

(74) *Attorney, Agent, or Firm* — Suzanne Gagnon; American Honda Motor Co., Inc.

(57) ABSTRACT

A cleaning apparatus for a tool is provided. The cleaning apparatus includes a support structure having a first base portion, and a nozzle disposed on the first base portion of the support structure. The cleaning apparatus further includes circuitry that is communicatively coupled to an electronically-actuated fluid release mechanism and a robot. The circuitry determines a count of operation cycles of the tool coupled to an end-effector of the robot and instructs the robot to align the tool with the nozzle. The instruction is provided to the robot based on a determination that the determined count is greater than or equal to a threshold number. The circuitry controls the electronically-actuated fluid release mechanism based on whether the tool is aligned with the nozzle, to release a cleaning fluid through the nozzle for a first time-duration to clean the tool.

13 Claims, 7 Drawing Sheets

TOOL CLEANING APPARATUS

BACKGROUND

A shop floor, especially in automotive sector, typically uses programmed robots for different operations. These robots may include an end-effector and a tool attached to the end-effector. Over a period of use, the tool may accumulate debris, which may clog certain parts of the tool and may limit further use of the tool. The debris may come from dust created during operations of the tool on work-piece(s). In some instances, the debris may be a result of dust generated from other manufacturing operations on the shop floor. The debris may impact the effectiveness of the tool and thereby, may result in reduced availability of the tool for additional operations cycles.

For example, a tool, such as a stud driver may typically accumulate dust during several tightening cycles. The dust may accumulate in certain parts of the stud driver and may cause tightening problems, for example, when studs are picked up to be tightened to an engine head. Typically, a human worker may be needed to clean the stud driver with a lubricant several times within working hours. The lubricant may clean some of the debris out of the stud driver but may allow a portion of the debris to stick together and stay inside the stud driver. Lubricants may mitigate the tightening problem by a certain factor but may require a lot of attention from human workers, which may increase a time and cost of maintenance as well as impact a speed of production on the shop floor.

Further limitations and disadvantages of conventional and traditional approaches will become apparent to one of skill in the art, through comparison of described systems with some aspects of the present disclosure, as set forth in the remainder of the present application and with reference to the drawings.

SUMMARY

An exemplary aspect of the disclosure provides a cleaning apparatus. The cleaning apparatus may include a support structure that may include a first base portion. The cleaning apparatus may further include a nozzle disposed on the first base portion of the support structure. The cleaning apparatus may further include circuitry that may be communicatively coupled to an electronically-actuated fluid release mechanism and a robot. The circuitry may be configured to determine a count of operation cycles of a tool coupled to an end-effector of the robot and instruct the robot to align the tool with the nozzle. The robot may be instructed based on a determination that the determined count is greater than or equal to a threshold number. The circuitry may be further configured to control the electronically-actuated fluid release mechanism based on whether the tool is aligned with the nozzle, to release a cleaning fluid through the nozzle for a first time-duration to clean the tool.

Another exemplary aspect of the disclosure provides a cleaning apparatus for cleaning a tool. The cleaning apparatus may include circuitry communicatively coupled to an electronically-actuated fluid release mechanism and a robot. The circuitry may be configured to determine a count of operation cycles of the tool coupled to an end-effector of the robot and instruct the robot to align the tool with a nozzle coupled to the electronically-actuated fluid release mechanism. The robot may be instructed based on a determination that the determined count is greater than or equal to a threshold number. The circuitry may be further configured to control the electronically-actuated fluid release mechanism based on whether the tool is aligned with the nozzle, to release a cleaning fluid through the nozzle for a first time-duration to clean the tool.

Another exemplary aspect of the disclosure provides a method for cleaning a tool. The method may include determining a count of operation cycles of the tool coupled to an end-effector of a robot and instructing the robot to align the tool with a nozzle coupled to an electronically-actuated fluid release mechanism. The robot may be instructed based on a determination that the determined count is greater than or equal to a threshold number. The method may further include controlling the electronically-actuated fluid release mechanism based on whether the tool is aligned with the nozzle, to release a cleaning fluid through the nozzle for a first time-duration to clean the tool.

This summary is provided to introduce a selection of concepts in a simplified form that are further disclosed in the detailed description of the present disclosure. This summary is not intended to identify key or essential inventive concepts of the claimed subject matter, nor is it intended for determining the scope of the claimed subject matter.

Figure 1:
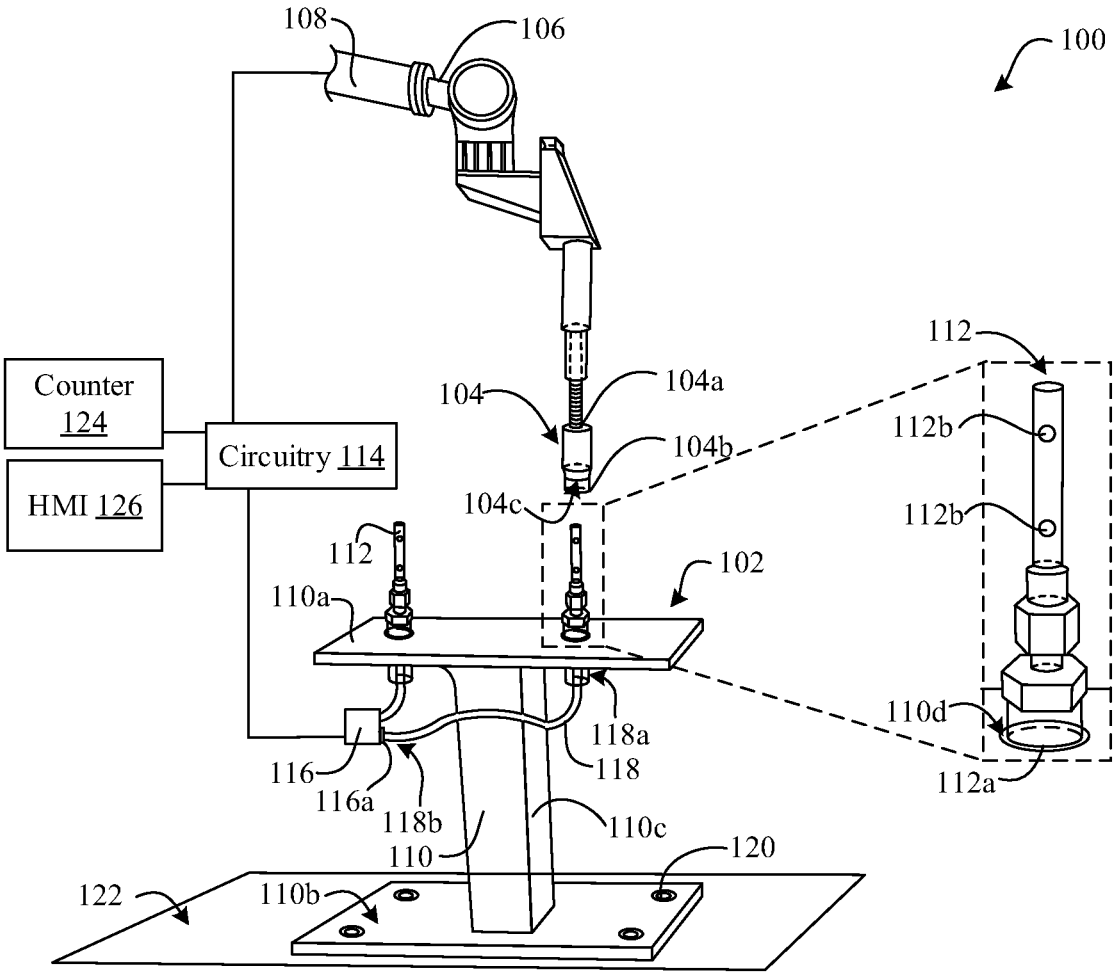
FIG. 1 is a diagram that illustrates an exemplary cleaning apparatus for a tool, in accordance with an embodiment of the disclosure.

The foregoing summary, as well as the following detailed description of the present disclosure, is better understood when read in conjunction with the appended drawings. For the purpose of illustrating the present disclosure, exemplary constructions of the preferred embodiment are shown in the drawings. However, the present disclosure is not limited to the specific methods and structures disclosed herein. The description of a method step or a structure referenced by a numeral in a drawing is applicable to the description of that method step or structure shown by that same numeral in any subsequent drawing herein.

DETAILED DESCRIPTION

The following described implementations may provide a cleaning operation for a tool, for example, a stud driver. For the cleaning operation, the disclosure provides a cleaning apparatus, which may be used to clean the tool while the tool is coupled to an end-effector of a robot. The cleaning apparatus may include a support structure and a nozzle supported on a first base portion of the support structure. The support structure may have a substantially I-shaped profile or H-shaped profile to provide a stability to the cleaning apparatus. The cleaning apparatus may further include circuitry that may be communicatively coupled to an electronically-actuated fluid release mechanism and the robot. The cleaning apparatus may automatically determine a count of operation cycles of the tool and may instruct the robot to align the tool with the nozzle based on whether the determined count is greater than or equal to a threshold number, for example, 100 operation cycles. Once the tool is aligned with the nozzle, the cleaning apparatus may control the electronically-actuated fluid release mechanism to release a cleaning fluid through the nozzle to clean the tool. As the fluid may be released with a set pressure, the release may cause a removal of debris from all portions, especially the interior portion, of the tool. Also, as the tool may be thoroughly cleaned every time the tool completes a set number of operations cycles, the availability, reusability, and life of the tool may increase. As a result, total time and cost of maintenance may go down and productivity of workers may improve. Also, as the tool may be cleaned using a pressurized fluid, an overall cleaning time may be less than that of lubricant-based manual cleaning operation. Therefore, once cleaned, the tool can be quickly configured for next set of operation cycles.

In an exemplary implementation, the cleaning operation may use compressed air to clean the inside of a stud driver after a set number of tightening cycles, e.g., 100. In one embodiment, one tightening cycle may include installation of four studs into an engine head. The cleaning operation may also use robotics, a Programming Logic Controller (PLC), Human-Machine Interface (HMI), and pneumatics to clean the stud drivers with minimal human interaction. The cleaning operation may eliminate a need for human workers to manually clean the stud driver during work hours and may greatly reduce an amount of tightening problems which may usually occur when the stud driver accumulates debris.

Reference will now be made in detail to specific aspects or features, examples of which are illustrated in the accompanying drawings. Wherever possible, corresponding or similar reference numbers will be used throughout the drawings to refer to the same or corresponding parts.

FIG. 1 is a diagram that illustrates an exemplary cleaning apparatus for a tool, in accordance with an embodiment of the disclosure. With reference to FIG. 1, there is shown an exemplary view 100 of a cleaning apparatus 102 and a tool 104 that may be coupled to an end-effector 106 of a robot 108. The exemplary view 100 may be a part of a production or manufacturing environment, for example, a shop floor of a vehicle manufacturing plant. The cleaning apparatus 102 may include a support structure 110, a nozzle 112, and circuitry 114 communicatively coupled to the robot 108 and an electronically-actuated fluid release mechanism 116.

The cleaning apparatus 102 may include provisions that may allow the cleaning apparatus 102 to control a cleaning operation of the tool 104 at specific intervals or after a certain number of operation cycles of the tool 104 based on rules or programmable control logic (e.g., in the form of computer-executable scripts, machine code, or instructions). In some embodiments, the cleaning apparatus 102 may be fixed adjacent to the tool 104 and during the cleaning operation, the tool 104 may be configured to be moved towards the cleaning apparatus 102, so that, the cleaning apparatus 102 may clean the tool 104. In other embodiments, the cleaning apparatus 102 may be moveably disposed adjacent to the tool 104 and during the cleaning operation, the cleaning apparatus 102 may be configured to move towards the tool 104, so that, the cleaning apparatus 102 may clean the tool 104 while the tool 104, end effector 106, and/or the robot 108 stays at its current position.

The tool 104 may have a suitable structure, design, or a shape profile that may allow a first end 104*a* of the tool 104 to be coupled to the end-effector 106 and a second end 104*b* to remain free to operate on workpiece(s) or for assembly of two or more objects together for a set number of operation cycles. In at least one embodiment, the tool 104 may be implemented as a stud driver and the operation cycles of the tool 104 may correspond to tightening cycles, in which studs may be tightened to an engine head. Other implementations of the tool 104 may include, but are not limited to, a drilling tool, a chuck, a gripper tool, a turning tool, a milling tool, a bolting tool, or a riveting tool. In such an implementations, the tool 104 may be used for operations that such as, but not limited to, drilling, milling, turning, studding, screwing, bolting, or riveting, and the like.

The end-effector 106 may have a suitable structure, circuitry, or an interface that may be configured to control the movement of the tool 104 along a set degrees of freedom, for example, 6 degrees of freedom (6 DOF). For example, on instructions of the robot 108, the end-effector 106 may maneuver the tool 104 towards the cleaning apparatus 102 and may align the tool 104 with the nozzle 112 of the cleaning apparatus 102 at set co-ordinates. The end-effector 106 may hold onto or grip the tool 104 by at least one of, a mechanical gripping means, a pneumatic suction means, or a magnetic means.

The robot 108 may have a suitable structure, circuitry, and interface that may be configured to control the end-effector 106 to maneuver and operate the tool 104 based on stored instructions for a set number of operation cycles. Additionally, the robot 108 may control the end-effector 106 to align the tool 104 with the nozzle 112 for a clean-up based on instructions from the cleaning apparatus 102 after the set number of operation cycles, e.g., 100, of the tool 104. For example, in case the tool 104 is a stud driver, then the robot 108 may control the end-effector 106 to maneuver the stud driver to tighten studs for a set number of tightening cycles. Once the tool 104 completes a set number of tightening cycles, the robot 108 may be instructed to align the stud driver with the nozzle 112 of the cleaning apparatus 102.

In an embodiment, the robot 108 may be an industrial robot that may be automated, programmable, and capable of movement on three or more axis. Although the present disclosure illustrates that a single end-effector is coupled to the robot 108; however, one skilled in the art will understand that the robot 108 may include more than one end-effector to control multiple tools (of a same or a different type) simultaneously or in particular order.

The support structure 110 may include a suitable structure and design that may allow the support structure to provide stability to different components of the cleaning apparatus 102 while supporting the weight of such components. The support structure 110 may include a first base portion 110*a*, a second base portion 110*b* substantially parallel to the first base portion 110*a*, and at least one pillar 110*c* that may extend between the first base portion 110*a* and the second base portion 110*b*. In one embodiment, the stability provided by the support structure 110 may be achieved by arranging the pillar 110*c* perpendicular to the first base portion 110*a* and the second base portion 110*b*. In such instances, the support structure 110 may be shaped to have a substantially I-shaped profile or H-shaped profile.

The first base portion 110*a* may have a substantially rectangular profile and may be configured to hold at least one nozzle, such as the nozzle 112. The first base portion 110*a* may include a slot 110*d* to receive a conduit 118. The conduit 118 may include a first end 118*a* and a second end 118*b*. The first end 118*a* of the conduit 118 may be configured to be coupled to a mouth 112*a* of the nozzle 112 and the second end 118*b* of the conduit 118 may be configured to be coupled to a port 116*a* of the electronically-actuated fluid release mechanism 116.

The second base portion 110*b* may also have a substantially rectangular profile and may include at least one fastener 120 through which the second base portion 110*b* may be affixed to a work floor 122. Alternatively, in at least one embodiment, the second base portion 110*b* may be configured to be moveable on the work floor 122 through a guide rail (as shown in FIG. 4 and FIGS. 5A, 5B, and 5C) or other moveable mechanism, such as a robot (not shown). Although, in FIG. 1, the first base portion 110*a* and the second base portion 110*b* are shown to have substantially rectangular profiles; however, one skilled in that art will understand that both the first base portion 110*a* and the second base portion 110*b* may have any other structural profile, such as, but not limited to a circular profile or a square profile.

The pillar 110*c* may have a substantially rectangular profile and may be configured to support the first base portion 110*a* and the second base portion 110*b*. The pillar 110*c* may be disposed substantially perpendicular to the first base portion 110*a* and the second base portion 110*b*. In FIG. 1, the pillar 110*c* is shown to have a substantially rectangular profile; however, one skilled in that art will understand that the pillar 110*c* may have any other structural profile, such as, but not limited to a circular profile or a square profile, or a frustoconical profile.

The nozzle 112 may have a suitable structure and design that may allow the nozzle 112 to eject the cleaning fluid at a required pressure towards the tool 104 when the tool 104 is aligned and/or engaged with the nozzle 112. The nozzle 112 may be disposed on the slot 110*d* of the first base portion 110*a*, with the mouth 112*a* configured to engage with the first end 118*a* of the conduit 118. As shown, for example, the nozzle 112 may be vertically disposed onto the first base portion 110*a*. The conduit 118 may provide a passage to the cleaning fluid to flow from a source (e.g., a pressurized fluid tank or an air pump) and towards the nozzle 112. In at least one embodiment, the nozzle 112 may have a substantially cylindrical structure having a plurality of holes 112*b* disposed at least radially on the substantially cylindrical structure of the nozzle 112. Each hole of the plurality of holes 112*b* that may be radially formed on the cylindrical structure may allow the nozzle 112 to uniformly release the cleaning fluid for removal of debris accumulated on the tool, especially from an interior portion 104*c* of the tool 104. The plurality of holes 112*b* may be disposed at strategically spaced intervals to improve the flow of the cleaning fluid and for a thorough removal of the debris from the tool 104. In at least one embodiment, the nozzle 112 may be configured to extend from the conduit 118 as an integral part of the conduit 118. In such an implementation, the first end 118*a* of the conduit 118 may be integrally formed as the nozzle (not shown) and may include holes that may be radially disposed on external surface of the conduit 118.

The circuitry 114 may be configured to execute program instructions associated with different operations to be executed by the cleaning apparatus 102. The circuitry 114 may include one or more specialized processing units, which may be implemented as an integrated processor or a cluster of processors that perform the functions of the one or more specialized processing units, collectively. The circuitry 114 may be implemented based on a number of processor technologies known in the art. In an exemplary implementation, the circuitry 114 may be implemented as a Programmable Logic Controller (PLC) which may be a computing system configured to control operations of the cleaning apparatus 102. Other implementations of the circuitry 114 may include, for example, an x86-based processor, a Reduced Instruction Set Computing (RISC) processor, an Application-Specific Integrated Circuit (ASIC) processor, a Complex Instruction Set Computing (CISC) processor, a microcontroller, a Central Processing Unit (CPU), a co-processor, a Graphics Processing Unit (GPU), and/or a combination thereof.

In at least one embodiment, the circuitry 114 may be communicatively coupled to a counter 124 which may be configured to determine a count of operation cycles of the tool 104. Alternatively, the counter 124 may be a computer-executable program, stored in memory on one of: the cleaning apparatus 102 or the robot 108 and may be configured to store the count of operation cycles of the tool 104.

In at least one embodiment, the cleaning apparatus 102 may include the electronically-actuated fluid release mechanism 116. The electronically-actuated fluid release mechanism 116 may have a suitable structure, circuitry, design, and/or interface that may be configured to control the release of the cleaning fluid through the nozzle 112 based on the instructions/control signals received from the circuitry 114. The cleaning fluid may be one of: a compressed gas (for example, compressed air) or a cleaning liquid.

Figure 6:
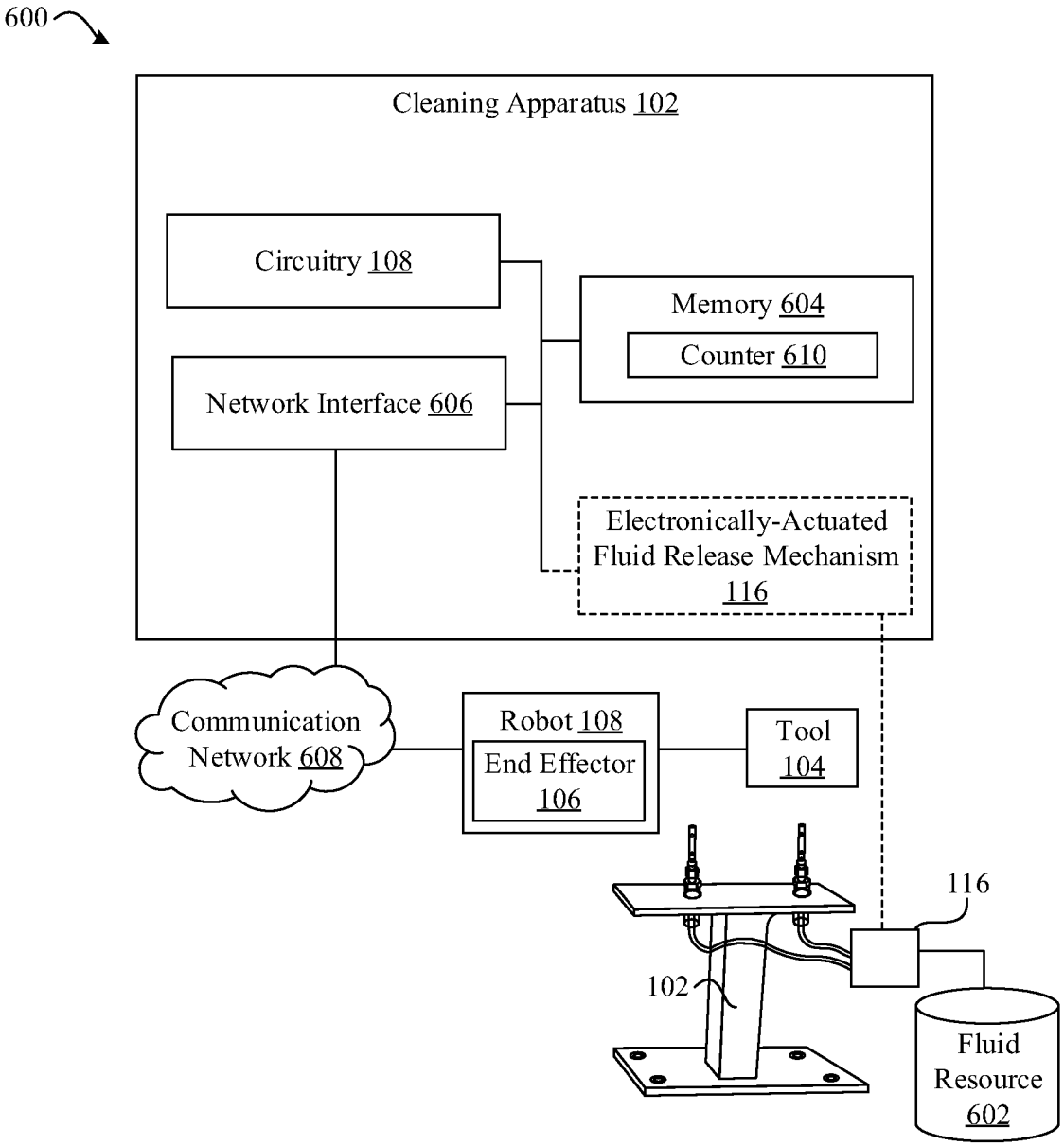
FIG. 6 is a block diagram of the cleaning apparatus of FIG. 1, in accordance with an embodiment of the disclosure.

By way of example, and not limitation, the electronically-actuated fluid release mechanism 116 may include a directional control valve that may be coupled to a fluid resource (as described in FIG. 6). The fluid resource may be a liquid reservoir or a compressed gas reservoir. Based on control signals/instruction from the circuitry 114, the directional control valve may be actuated to control the release of the cleaning fluid from the port 116*a* and through the nozzle 112. By way of another example, and not limitation, the electronically-actuated fluid release mechanism 116 may include an air pump and a solenoid-based actuator that may be coupled to the air pump and the circuitry 114. Based on control signals/instruction from the circuitry 114, the solenoid-based actuator may control the air pump to draw air from the surrounding and pass compressed air through the nozzle 112 at a pressure which may be desirable for the clean-up of the tool.

In accordance with an embodiment, the circuitry 114 may be communicatively coupled to a Human-Machine Interface (HMI) 126. The HMI 126 may include suitable logic, circuitry, and interface that may be configured to provide an Input/output (I/O) interface between a human operator and the cleaning apparatus 102. The HMI 126 may include at least one input device and/or at least one output device. Examples of the input device may include, but is not limited to, a touch screen, a keyboard, a mouse, a joystick, a microphone, a gesture controller, an image sensor and/or other variants of input devices. Examples of the output device may include, but is not limited to, a display screen (such as a Liquid Crystal Display (LCD) or a Light Emitting Diode (LED) display), a haptic device, and/or a speaker.

Figure 2:
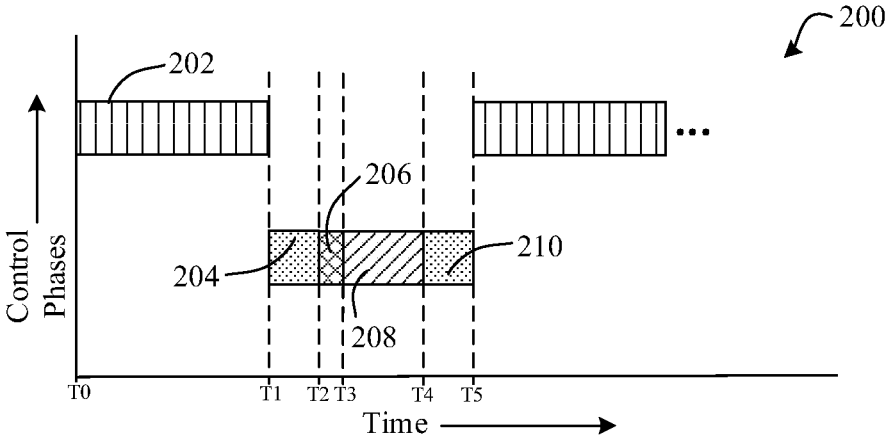
FIG. 2 illustrates an operation timeline of the exemplary cleaning apparatus of FIG. 1, in accordance with an embodiment of the disclosure.

FIG. 2 illustrates an operation timeline of the exemplary cleaning apparatus of FIG. 1, in accordance with an embodiment of the disclosure. FIG. 2 is explained in conjunction with elements from FIG. 1. With reference to FIG. 2, there is shown an operation timeline 200 which depicts different phases of operation of the cleaning apparatus 102. The circuitry 114 may control the operation of the cleaning apparatus 102 in such phases, as described herein.

In an initial phase 202, the circuitry 114 may determine a count of operation cycles of the tool 104. In an exemplary embodiment, the tool 104 may be in a default operation position and the circuitry 114 may instruct the robot 108 to proceed with a preset operation of the tool 104. The count of the operation cycles may start from $T_0$ and proceed till $T_1$ seconds. The counter 124 may store the count of operation cycles from $T_0$ till $T_1$ (in seconds). At $T_1$, the count of operation cycles may equal or exceed the threshold number (e.g., 100) and the circuitry 114 may instruct the robot 108 to align the tool 104 with the nozzle 112 of the cleaning apparatus 102.

In an alignment phase 204, the robot 108 may control the end-effector 106 to align the tool 104 with the nozzle 112 of the cleaning apparatus 102. The alignment phase 204 may start from $T_1$ and may continue till $T_2$ (in seconds).

In an engagement phase 206, while the tool 104 is aligned with the nozzle 112, the circuitry 114 may instruct the robot 108 to move the tool 104 to engage with the nozzle 112. The engagement phase 206 may start from $T_2$ and may proceed till $T_3$ (in seconds). For example, after aligning the tool 104 with the nozzle 112 at $T_2$, the robot 108 may move the tool 104 so that the tool 104 engages with the nozzle 112 at $T_3$. Upon engagement of the tool 104 with the nozzle 112, a control phase 208 may be initialized.

In the control phase 208, the circuitry 114 may control the electronically-actuated fluid release mechanism 116 to release the cleaning fluid through the nozzle 112 from $T_3$ and till $T_4$ (e.g., 2 seconds) to clean the tool 104. Here, the difference ($T_4$–$T_3$) may be equal to a first time duration for which the cleaning fluid may be released to clean the nozzle 112. The release of the cleaning fluid may cause removal of the debris accumulated in the tool 104, especially in the interior portion 104*c* of the tool 104. After the cleaning fluid is released from $T_3$ and till $T_4$, the circuitry 114 may control the electronically-actuated fluid release mechanism 116 to stop the release of the cleaning fluid through the nozzle 112.

In a reset phase 210, the circuitry 114 may reset the counter 124 to a default count value (e.g., 0) after the cleaning fluid is released from $T_3$ and till $T_4$. Once the counter 124 is reset, the circuitry 114 may instruct the robot 108 to maneuver and place the tool 104 in the default position. When the tool 104 is at the default position, the circuitry 114 may instruct the robot 108 to resume a preset operation of the tool 104 for a next set of operation cycles.

In at least one embodiment, a human user (e.g., an operator) may be able to override the reset phase 210 or any other phase by providing a user input via the HMI 126. The circuitry 114 may be communicatively coupled to the HMI 126 and may receive the user input through the HMI 126. In an exemplary embodiment, based on the received user input, the circuitry 114 may instruct the robot 108 to stop the preset operation of the tool 104 and align back the tool 104 with the nozzle 112. Based on whether the tool 104 is aligned with the nozzle 112, the circuitry 114 may control the electronically-actuated fluid release mechanism 116 to release the cleaning fluid through the nozzle 112 for a first time duration (similar to $T_4$–$T_3$) to clean the tool 104.

Figure 3A:
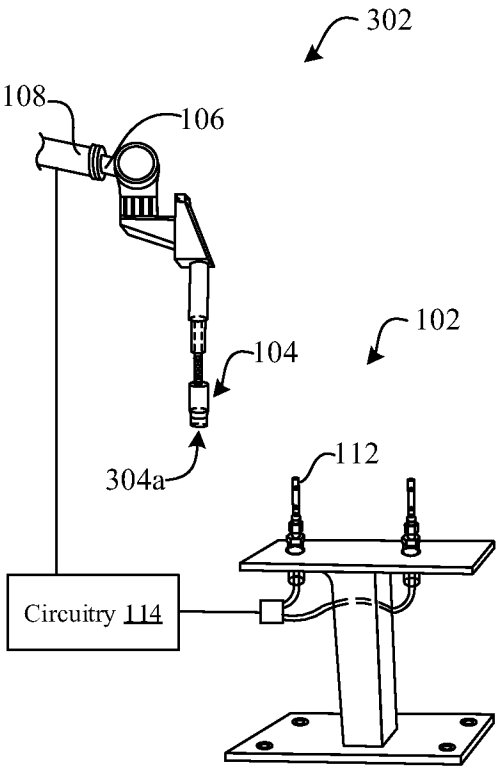
FIGS. 3A, 3B, and 3C are diagrams that collectively illustrate exemplary operations for automated cleanup of a tool by the exemplary cleaning apparatus of FIG. 1, in accordance with an embodiment of the disclosure.
Figure 3B:
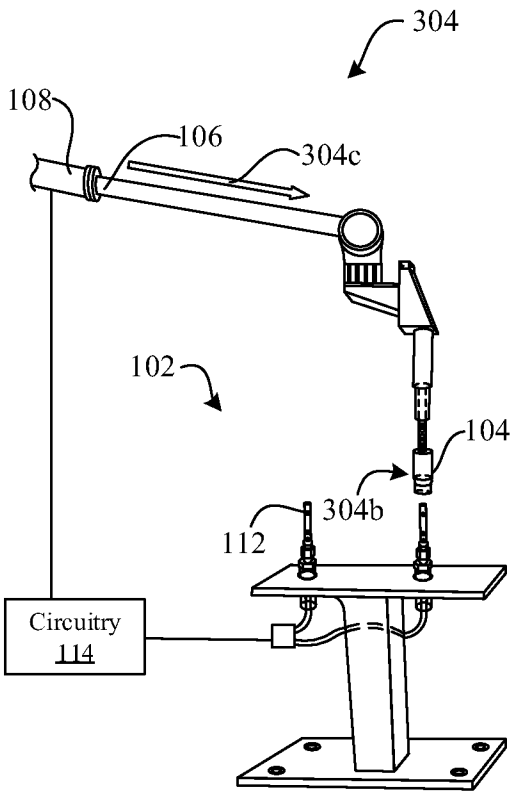
Figure 3C:
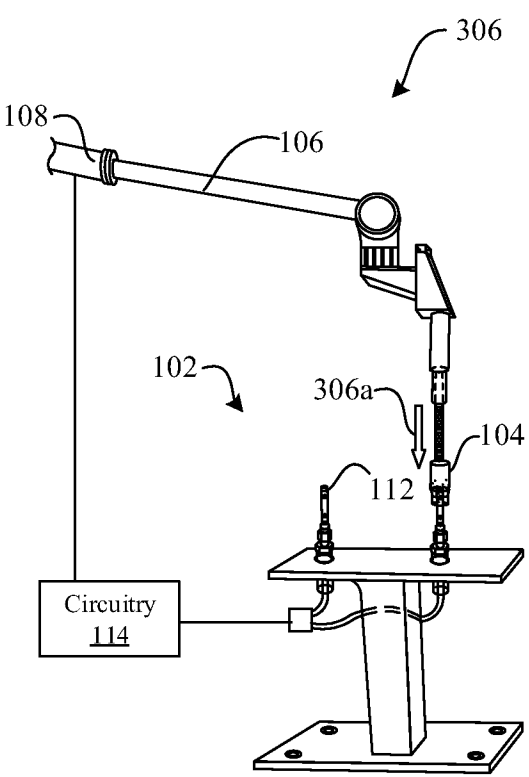

FIGS. 3A, 3B, and 3C are diagrams that collectively illustrate exemplary operations for automated cleanup of a tool by the exemplary cleaning apparatus of FIG. 1, in accordance with an embodiment of the disclosure. FIGS. 3A, 3B, and 3C are explained in conjunction with elements from FIG. 1 and FIG. 2. With reference to FIGS. 3A, 3B, and 3C, exemplary operations are illustrated using a sequence of relative configurations of the cleaning apparatus 102 and the tool 104. The sequence of configurations may include an initial configuration 302, an alignment configuration 304, and an engaged configuration 306.

In the initial configuration 302, the robot 108 may be positioned adjacent to the cleaning apparatus 102 while the tool 104 is coupled to the end-effector 106 of the robot 108. In accordance with a preset operation of the tool 104, the robot 108 may control the end-effector 106 to operate the tool 104 for a number of operation cycles of the tool 104. While the robot 108 operates the tool 104, the circuitry 114 may determine a count of operation cycles of the tool 104. For example, the circuitry 114 may use the counter 124 to store the count of operation cycles. In some instances, the robot 108 may be programmed to periodically share the count of operation cycles with the circuitry 114, via a message signal. The circuitry 114 may determine whether the determined count of operation cycles is greater than or equal to a threshold number, for example, 100 operation cycles. In case the determined count is greater than or equal to the threshold number, the circuitry 114 may instruct the robot 108 to stop a preset operation (e.g., tightening operation or other tool-related operations) of the tool 104 and align the tool 104 with the nozzle 112 of the cleaning apparatus 102.

In the alignment configuration 304, the robot 108 may align the tool 104 with the nozzle 112 of the cleaning apparatus 102 based on instructions received from the circuitry 114. Specifically, the robot 108 may control the end-effector 106 to maneuver the tool 104 from a default position 304*a* to a desirable position 304*b*, where the tool 104 may be aligned with the nozzle 112. Herein, as the nozzle 112 is shown to be vertically disposed on the first base portion 110*a*, the end-effector 106 of the robot 108 may extend along a first direction 304*c* to vertically align the tool 104 with the nozzle 112. By way of example, and not limitation, when the tool 104 is a stud driver, the threshold number of tightening cycles may be set to 100. If the count of tightening cycles exceeds or equals hundred tightening cycles, the end-effector 106 may maneuver the stud driver so that the stud driver is aligned with the nozzle 112.

In some embodiments, the circuitry 114 may determine whether the tool 104 is aligned with the nozzle 112. For example, a proximity sensor or camera unit (not shown) may be installed next to the nozzle 112 on the support structure 110. When the proximity sensor or the camera unit detects that the tool 104 is at the desirable position 304*b* with respect to a position of the nozzle 112, a message may be shared with the circuitry 114 to indicate that the tool 104 is aligned with the nozzle 112. Alternatively, upon alignment, the robot 108 may generate a message which may be shared with the circuitry 114 to indicate that the tool 104 is aligned with the nozzle 112. Based on a determination that the tool 104 is aligned with the nozzle 112, the circuitry 114 may control the electronically-actuated fluid release mechanism 116 to release a cleaning fluid through the nozzle 112 for a first time-duration (for example, for 2 seconds) to clean the tool 104.

In the engaged configuration 306, the circuitry 114 may instruct the robot 108 to move the tool 104 to engage with the nozzle 112 while the tool 104 is aligned with the nozzle 112. Based on instructions from the circuitry 114, the end-effector 106 of the robot 108 may extend along a second direction 306*a* to engage (or mate) the tool 104 with the nozzle 112. For example, as shown, the tool 104 partially encloses the nozzle 112 of the cleaning apparatus 102 in the engaged configuration 306. Upon alignment and engagement with the nozzle 112, the circuitry 114 may control the electronically-actuated fluid release mechanism 116 to release the cleaning fluid through the nozzle 112 for the first time-duration (for example, 2 seconds) to clean the tool 104. In such a configuration, the interior portion 104*c* of the tool 104 may enclose the plurality of holes 112*b* radially disposed on the nozzle 112. As the interior portion 104*c* may accumulate a larger portion of the debris, the release of the cleaning fluid may cause a removal of debris accumulated in the interior portion 104*c* of the tool 104.

After the cleaning fluid is released for the first time-duration, the circuitry 114 may control the electronically-actuated fluid release mechanism 116 to stop the release of the cleaning fluid through the nozzle 112 and reset the counter 124 to a default count value (for example, 0). Once the counter 124 is reset to the default count value, the circuitry 114 may instruct the robot 108 to place back the tool 104 at the default position 304*a* and resume the preset operation of the tool 104 for a next set of operation cycles based on a determination that the tool 104 is placed at the default position 304*a*.

In certain scenarios, a human operator may be able to manually override the preset operation of the tool 104 to initiate the cleaning operation for the tool 104. The operator may trigger the cleaning operation by providing a user input through the HMI 126. The circuitry 114 may receive the user input through the HMI 126. Based on the received user input, the circuitry 114 may instruct the robot 108 to stop the preset operation of the tool 104. Upon stopping the preset operation of the tool 104, the circuitry 114 may instruct the robot 108 to align the tool 104 with the nozzle 112. Based on whether the tool 104 is aligned with the nozzle 112, the circuitry 114 may control the electronically-actuated fluid release mechanism 116 to release the cleaning fluid through the nozzle 112 for the first time-duration to clean the tool 104.

Figure 4:
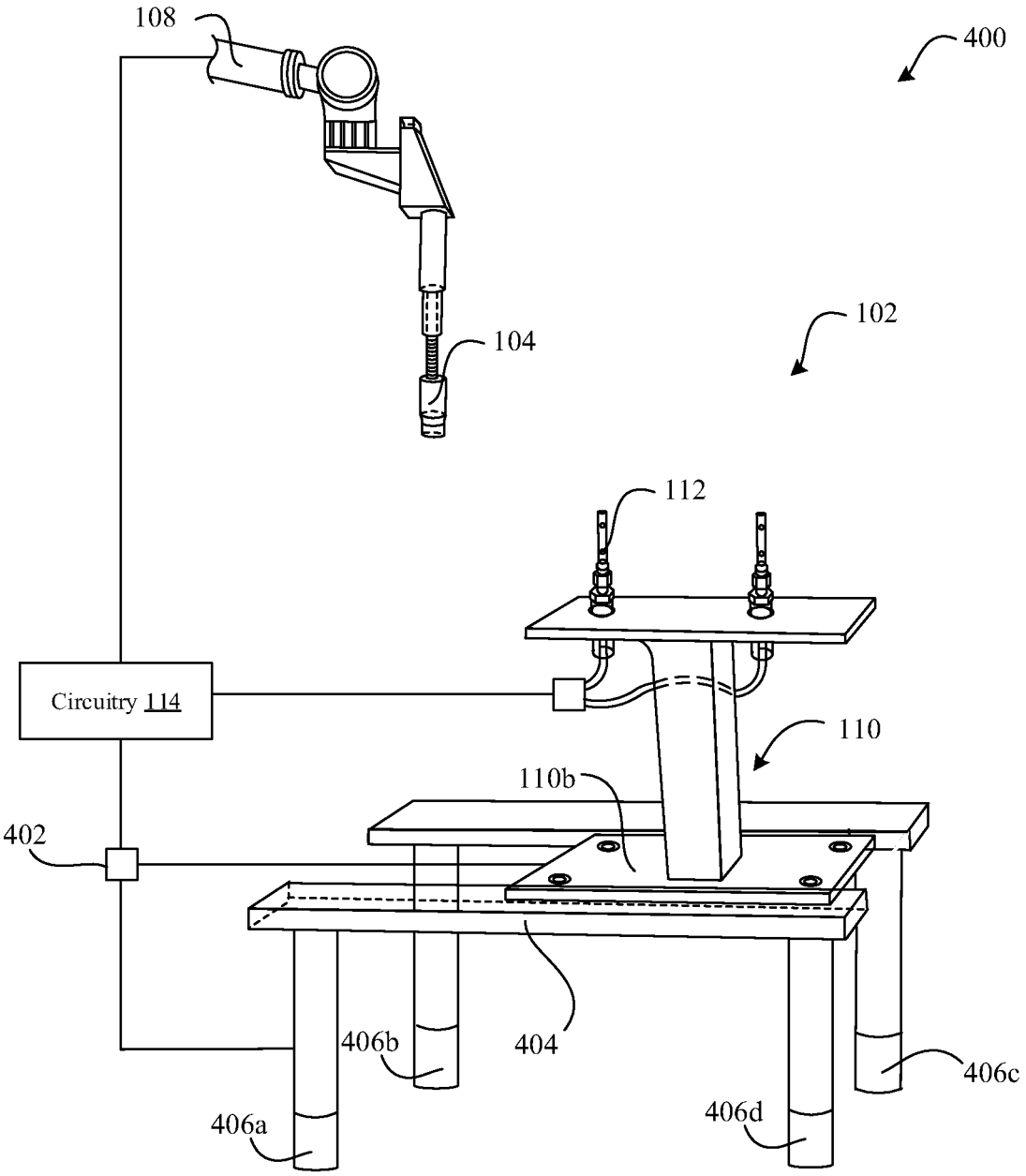
FIG. 4 is a diagram that illustrates an exemplary implementation of the cleaning apparatus of FIG. 1, in accordance with an embodiment of the disclosure.

FIG. 4 is a diagram that illustrates an exemplary implementation of the cleaning apparatus of FIG. 1, in accordance with an embodiment of the disclosure. FIG. 4 is explained in conjunction with elements from FIG. 1, FIG. 2, and FIGS. 3A, 3B, and 3C. With reference to FIG. 4, there is shown an exemplary implementation 400 of the cleaning apparatus 102. In the exemplary implementation 400, the cleaning apparatus 102 may include an electronically-controlled driving mechanism 402 that may be coupled to the support structure 110. The support structure 110 may be mounted on a guide rail 404. By way of example, and not limitation, the electronically-controlled driving mechanism 402 may include a linear actuator (not shown) disposed on the second base portion 110*b* of the support structure 110 and slidably mounted on the guide rail 404.

The guide rail 404 may include a set of lifting members 406*a*, 406*b*, 406*c*, and 406*d* which may be electronically-controlled to vertically lift the support structure 110. The electronically-controlled driving mechanism 402 may be responsible for a controlled movement of the support structure 110 horizontally along the guide rail 404 and/or vertically towards the tool 104.

Figure 5A:
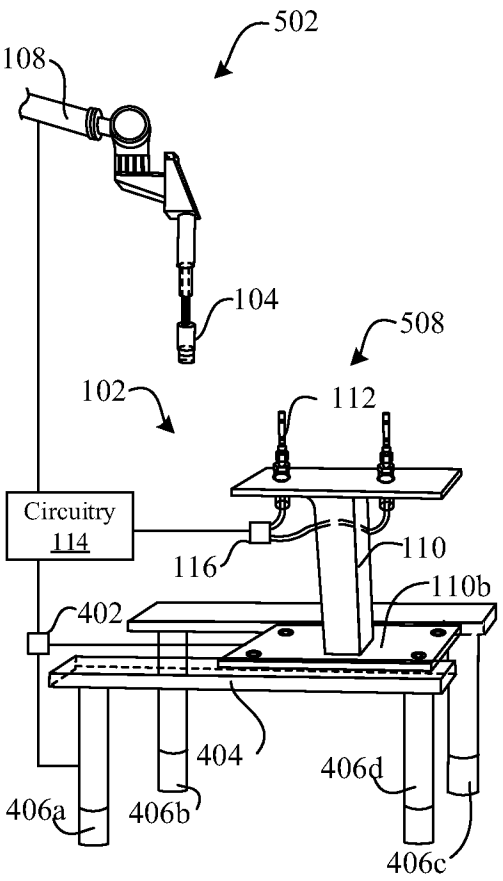
FIGS. 5A, 5B, and 5C are diagrams that collectively illustrate exemplary operations for automated cleanup of a tool by the cleaning apparatus of FIG. 4, in accordance with an embodiment of the disclosure.
Figure 5B:
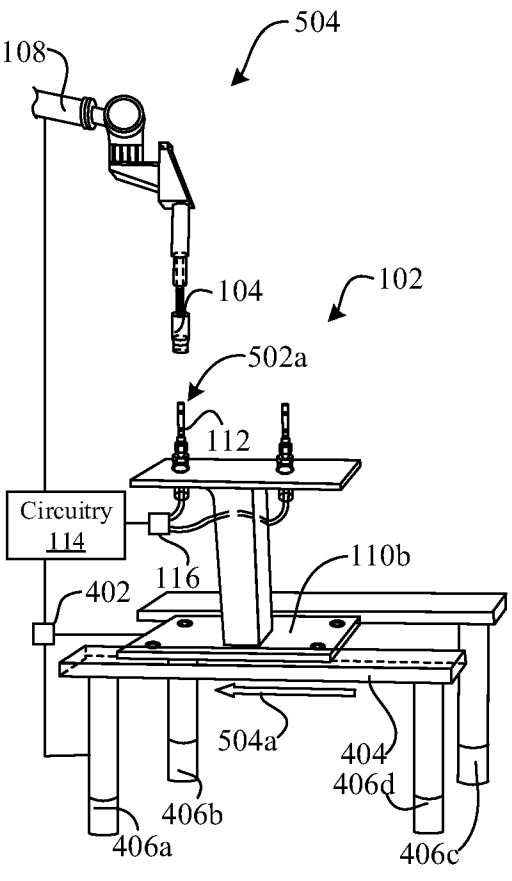
Figure 5C:
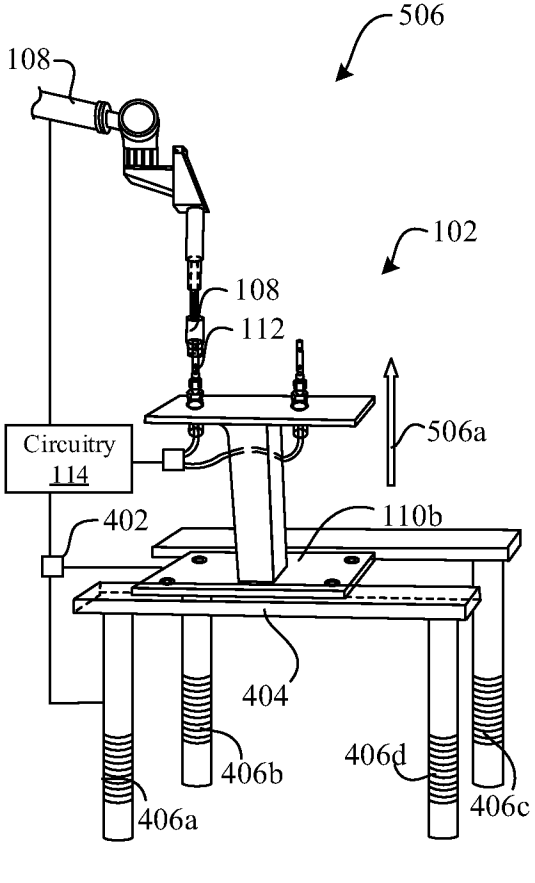

FIGS. 5A, 5B, and 5C are diagrams that collectively illustrate exemplary operations for automated cleanup of a tool by the cleaning apparatus of FIG. 4, in accordance with an embodiment of the disclosure. FIGS. 5A, 5B, and 5C are explained in conjunction with elements from FIGS. 1, 2, 3A, 3B, 3C, and 4. With reference to FIGS. 5A, 5B, and 5C, exemplary operations are illustrated using a sequence of relative configurations of the cleaning apparatus 102 of FIG. 4 and the tool 104. The sequence of configurations may include an initial configuration 502, an alignment configuration 504, and an engaged configuration 506.

In the initial configuration 502, the robot 108 may be positioned adjacent to the cleaning apparatus 102 while the tool 104 is coupled to the end-effector 106 of the robot 108. The robot 108 may control the end-effector 106 to operate the tool 104 for a number of operation cycles. While the robot 108 operates the tool 104, the circuitry 114 may determine a count of operation cycles of the tool 104. In case the determined count of the operation cycles is greater than or equal to the threshold value, the circuitry 114 may control the electronically-controlled driving mechanism 402 to move the support structure 110 on the guide rail 404 to reach a position 502*a* that is directly below the tool 104.

In the alignment configuration 504, the support structure 110 is shown to have moved on the guide rail 404 along a first direction 504*a* to vertically align the nozzle 112 with the tool 104. In the engaged configuration 506, the circuitry 114 may control the electronically-controlled driving mechanism 402 to maneuver the support structure 110 so that the nozzle 112 engages with the tool 104 while the nozzle 112 is vertically aligned with the tool 104. For example, the electronically-controlled driving mechanism 402 may control the set of lifting members 406*a*, 406*b*, 406*c*, and 406*d* to vertically lift the support structure 110 so that the nozzle 112 may engage with the tool 104. As shown, in the engaged configuration 506, the set of lifting members 406*a*, 406*b*, 406*c*, and 406*d* vertically lift the support structure 110 along a second direction 506*a* to engage the nozzle 112 with the tool 104.

Upon alignment and engagement of the nozzle 112 with the tool 104, the circuitry 114 may control the electronically-actuated fluid release mechanism 116 to release the cleaning fluid through the nozzle 112 for the first time-duration to clean the tool 104. After the cleaning fluid is released for the first time-duration, the circuitry 114 may control the electronically-actuated fluid release mechanism 116 to stop the release of the cleaning fluid through the nozzle 112 and reset the counter 124 to a default count value of 0. Once the counter 124 is reset, the circuitry 114 may instruct the cleaning apparatus 102 to maneuver and place the support structure 110 back to a default position 508, i.e. as also illustrated in the initial configuration 502. Upon reaching the default position 508, the circuitry 114 may instruct the robot 108 to resume the preset operation of the tool 104 for a next set of operation cycles.

FIG. 6 is a block diagram of the cleaning apparatus of FIG. 1, in accordance with an embodiment of the disclosure. FIG. 6 is explained in conjunction with elements from FIGS. 1, 2, 3A, 3B, 3C, 4, 5A, 5B, and 5C. With reference to FIG. 6, there is shown a block diagram 600 of the cleaning apparatus 102. The cleaning apparatus 102 may include the circuitry 114 to control the release of the cleaning fluid from a fluid resource 602. The cleaning apparatus 102 may further include a memory 604 and a network interface 606. The network interface 606 may communicate through a communication network 608 with external networking devices, such as the robot 108.

The fluid resource 602 may be configured to act as a source of the cleaning fluid and may include an air pump, a water pump, a liquid tank, a compressed gas tank, and the like. Each of the compressed gas tank or the liquid tank may be coupled to an electronically-actuated valve of the electronically-actuated fluid release mechanism 116.

The memory 604 may include suitable logic, circuitry, and interfaces that may be configured to store the program instructions which may be executable by the circuitry 114. Examples of the implementation of the memory 604 may include, but are not limited to, Random Access Memory (RAM), Read Only Memory (ROM), Electrically Erasable Programmable Read-Only Memory (EEPROM), Hard Disk Drive (HDD), a Solid-State Drive (SSD), a CPU cache, and/or a Secure Digital (SD) card. In at least one embodiment, the memory 604 may include a counter 610 (such as the counter 124) that may be configured to store a count of operation cycles of the tool 104. For example, in case of a stud driver, the counter 610 may count and store a number of tightening cycles (e.g., 4 studs per cycle). The memory 604 may also store information associated with a threshold number of operation cycles, based on which the cleaning operation may be triggered.

The network interface 606 may include suitable logic, circuitry, and interfaces that may be configured to facilitate a communication between the circuitry 114, the robot 108, and the electronically-actuated fluid release mechanism 116 via the communication network 608. The network interface 606 may be implemented by use of various known technologies to support wired or wireless communication of the cleaning apparatus 102 via the communication network 608. The network interface 606 may include, but is not limited to, an antenna, a radio frequency (RF) transceiver, one or more amplifiers, a tuner, one or more oscillators, a digital signal processor, a coder-decoder (CODEC) chipset, a subscriber identity module (SIM) card, or a local buffer circuitry.

The network interface 606 may be configured to communicate via wireless communication with networks, such as the Internet, an Intranet or a wireless network, such as a cellular telephone network, a wireless local area network (LAN), and a metropolitan area network (MAN). The wireless communication may use one or more of a plurality of communication standards, protocols and technologies, such as Global System for Mobile Communications (GSM), Enhanced Data GSM Environment (EDGE), wideband code division multiple access (W-CDMA), Long Term Evolution (LTE), code division multiple access (CDMA), time division multiple access (TDMA), Bluetooth, Wireless Fidelity (Wi-Fi) (such as IEEE 802.11a, IEEE 802.11b, IEEE 802.11g or IEEE 802.11n), voice over Internet Protocol (VoIP), light fidelity (Li-Fi), Worldwide Interoperability for Microwave Access (Wi-MAX), a protocol for email, instant messaging, and a Short Message Service (SMS).

The communication network 608 may include a communication medium through which the cleaning apparatus 102, the end-effector 106, the robot 108, and the electronically-actuated fluid release mechanism 116 may communicate with each other. The communication network 608 may be one of: a wired connection or a wireless connection. Examples of the communication network 608 may include, but are not limited to, the Internet, a cloud network, a Wireless Fidelity (Wi-Fi) network, a Personal Area Network (PAN), a Local Area Network (LAN), or a Metropolitan Area Network (MAN).

Components of the cleaning apparatus 102, the robot 108, and the electronically-actuated fluid release mechanism 116 may be configured to connect to the communication network 608 in accordance with various wired and wireless communication protocols. Examples of such wired and wireless communication protocols may include, but are not limited to, at least one of a Transmission Control Protocol and Internet Protocol (TCP/IP), User Datagram Protocol (UDP), Hypertext Transfer Protocol (HTTP), File Transfer Protocol (FTP), Zig Bee, EDGE, IEEE 802.11, light fidelity (Li-Fi), 802.16, IEEE 802.11s, IEEE 802.11g, multi-hop communication, wireless access point (AP), device to device communication, cellular communication protocols, and Bluetooth (BT) communication protocols.

Figure 7:
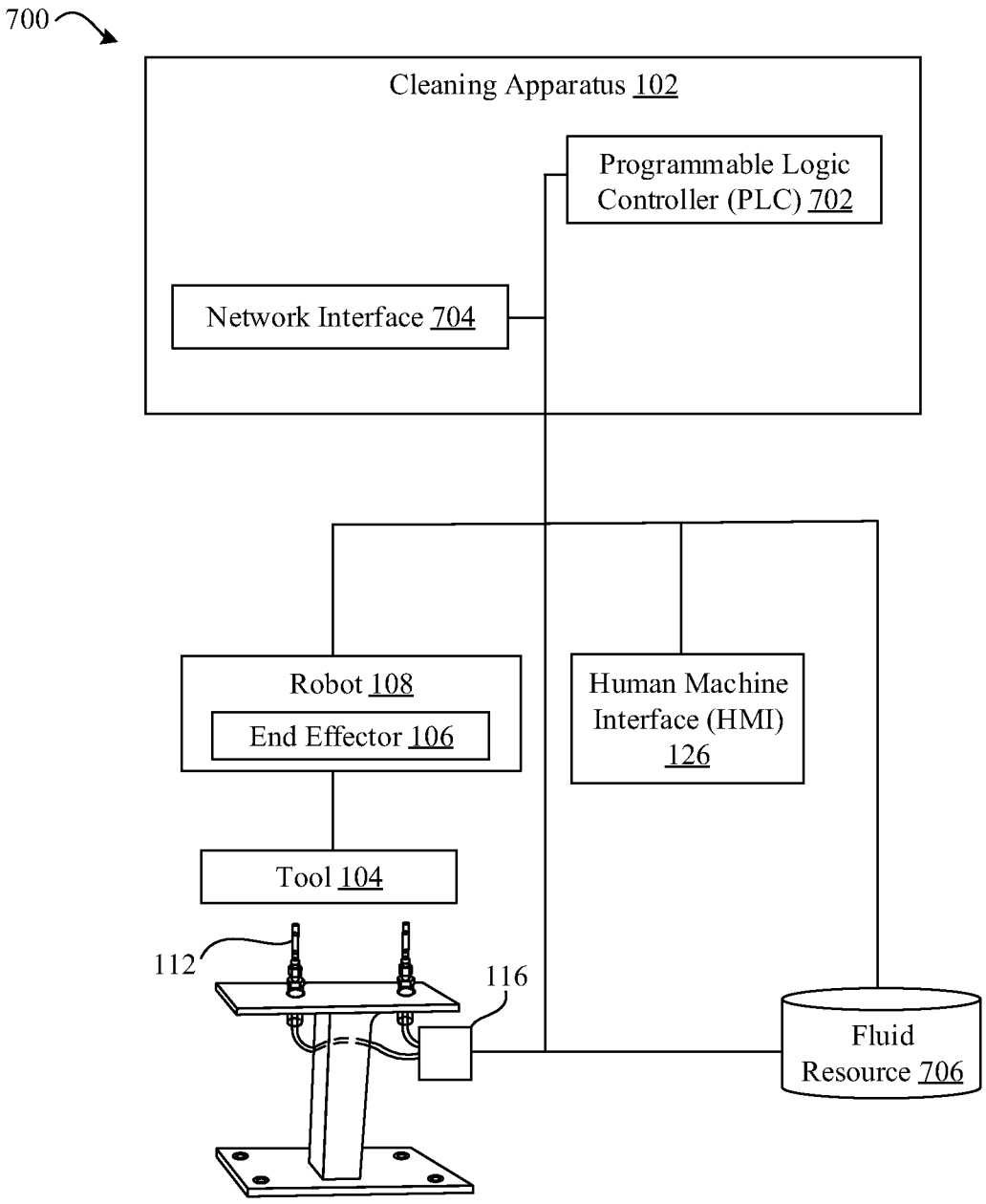
FIG. 7 is a block diagram that illustrates a PLC-based implementation of the cleaning apparatus, in accordance with an embodiment of the disclosure.

FIG. 7 is a block diagram that illustrates a PLC-based implementation of the cleaning apparatus, in accordance with an embodiment of the disclosure. FIG. 7 is explained in conjunction with elements from FIGS. 1, 2, 3A, 3B, 3C, 4, 5A, 5B, and 5C. With reference to FIG. 7, there is shown a block diagram 700 of the cleaning apparatus 102. The cleaning apparatus 102 may include a Programmable Logic Controller (PLC) 702 and a network interface 704. The PLC 702 may be an exemplary implementation of the circuitry 114 in a manufacturing environment, for example, an automobile manufacturing plant. The PLC 702 may be communicatively coupled to at least one of the robot 108, the end-effector 106 of the robot 108, the electronically-actuated fluid release mechanism 116, a fluid resource 706, and/or the HMI 126, via the network interface 704.

The PLC 702 may include suitable circuitry, logic, interfaces, and code that may be configured to control operations associated with a clean-up of the tool 104. The PLC 702 may include a dedicated CPU and an I/O interface to communicate with the robot 108, the end-effector 106 of the robot 108, the electronically-actuated fluid release mechanism 116, the fluid resource 706, and/or the HMI 126. The PLC 702 may also include additional components, such as a timer program or a timer circuit, a counter program or a counter circuit, and/or a persistent/non-persistent data storage. Details of the additional components are omitted from the disclosure for the sake of brevity.

The network interface 704 may be configured to communicate via wireless communication with networks, such as the Internet, an Intranet or a wireless network, such as a cellular telephone network, a wireless local area network (LAN), and a metropolitan area network (MAN). The wireless communication may use one or more of a plurality of communication standards, protocols and technologies, such as Global System for Mobile Communications (GSM), Enhanced Data GSM Environment (EDGE), wideband code division multiple access (W-CDMA), Long Term Evolution (LTE), code division multiple access (CDMA), time division multiple access (TDMA), Bluetooth, Wireless Fidelity (Wi-Fi) (such as IEEE 802.11a, IEEE 802.11b, IEEE 802.11g or IEEE 802.11n), voice over Internet Protocol (VoIP), light fidelity (Li-Fi), Worldwide Interoperability for Microwave Access (Wi-MAX), a protocol for email, instant messaging, and a Short Message Service (SMS).

The fluid resource 702 may be configured to act as a source of the cleaning fluid and may include an air pump, a water pump, a liquid tank, a compressed gas tank, and the like. Each of the compressed gas tank or the liquid tank may be coupled to an electronically-actuated valve of the electronically-actuated fluid release mechanism 116. In case the fluid resource 702 is an air pump, the electronically-actuated fluid release mechanism 116 may include a solenoid-based actuator coupled to the air pump.

For the cleaning operation, the PLC 702 may first start by counting the operation cycles of the tool 104 which may be attached the end-effector 106 of the robot 108. When the counter of the PLC 702 may reach a threshold number, such as a hundred, the PLC 702 may send a signal to the robot 108, instructing the robot to align the tool 104 with the nozzle 112. The robot 108 may control the end-effector 106 to move the tool 104 into multiple positions until the tool 104 is over the nozzle 112. The tool 104 may include holes through its cross section to clean majority of the surface area inside the tool 104. When the tool 104 is over the nozzle 112 and is well aligned, the robot 108 may send a signal to the PLC 702 to send command to the electronically-actuated fluid release mechanism 116 to release the cleaning fluid for a first time duration, for example, 2 seconds. For example, the command may be provided to the solenoid-based actuator to control the air pump to release air from the nozzle 112 for two seconds. Thereafter, The PLC 702 may send another command to the electronically-actuated fluid release mechanism 116 to stop releasing the cleaning fluid and to reset the counter. Then, the PLC 702 may send a signal to the robot 108 to move to a home position (i.e. a default position). As the counter is reset after the cleaning operation, the preset operation of the tool 104 may resume for a next set of operation cycles. The cleaning operation may be repeated every time the count of the operation cycles exceeds the threshold number.

Figure 8:
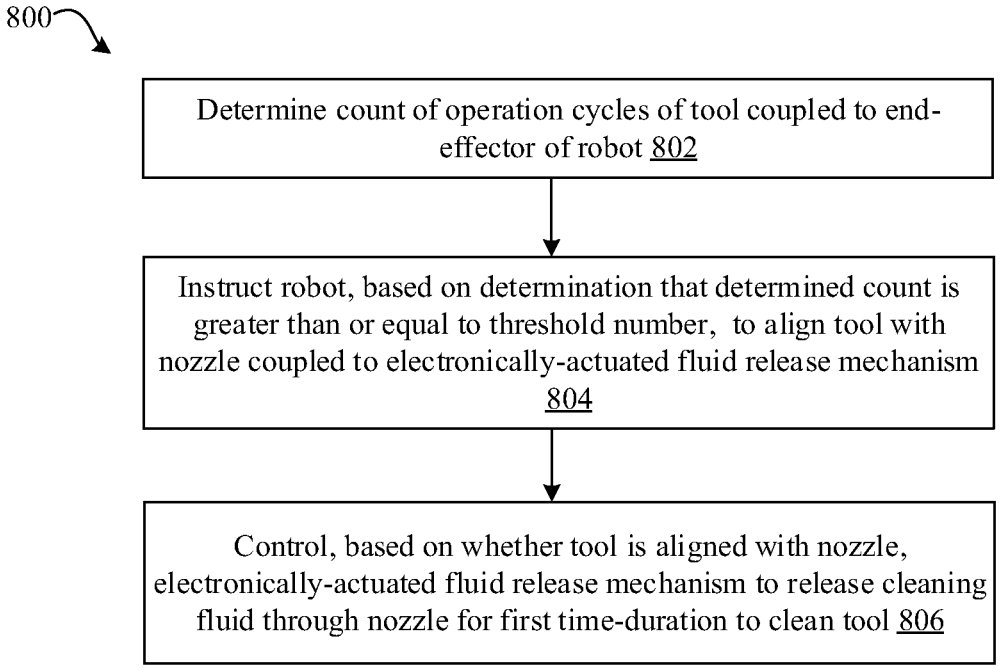
FIG. 8 is a flowchart that illustrates an exemplary method for cleaning a tool, in accordance with an embodiment of the disclosure.

FIG. 8 is a flowchart that illustrates an exemplary method for cleaning a tool, in accordance with an embodiment of the disclosure. FIG. 8 is explained in conjunction with elements from FIGS. 1, 2, 3A, 3B, 3C, 4, 5A, 5B, 5C, 6, and 7. With reference to FIG. 8, there is shown a flowchart 800 that depicts a method of cleaning the tool 104 of FIG. 1. The method illustrated in the flowchart 800 may start from 802.

At 802, a count of operation cycles of the tool 104 may be determined. In an embodiment, the circuitry 114 may determine the count of operation cycles of the tool 104.

At 804, the robot 108 may be instructed to align the tool 104 with the nozzle 112 based on a determination that the determined count is greater than or equal to a threshold number. In an embodiment, the circuitry 114 may instruct the robot 108 to align the tool 104 with the nozzle 112 coupled to the electronically-actuated fluid release mechanism 116.

At 806, the electronically-actuated fluid release mechanism 116 may be controlled based on whether the tool 104 is aligned with the nozzle 112 to release a cleaning fluid through the nozzle 112 for the first time-duration to clean the tool 104. In an embodiment, the circuitry 114 may control the electronically-actuated fluid release mechanism 116 to release the cleaning fluid through the nozzle 112 for the first time-duration to clean the tool 104. Control may pass to end.

The flowchart 800 is illustrated as discrete operations, such as 802, 804, and 806. However, in certain embodiments, such discrete operations may be further divided into additional operations, combined into fewer operations, or eliminated, depending on the implementation without detracting from the essence of the disclosed embodiments.

Various embodiments of the disclosure may provide a non-transitory computer readable medium and/or storage medium having stored thereon, instructions executable by a machine and/or a computer to operate a cleaning apparatus for a tool. The instructions may cause the machine and/or computer to perform operations that include determining a count of operation cycles of the tool coupled to an end-effector of a robot. The operations further include instructing the robot to align the tool with a nozzle coupled to an electronically-actuated fluid release mechanism. The robot may be instructed based on a determination that the determined count is greater than or equal to a threshold number. The operations further include controlling the electronically-actuated fluid release mechanism based on whether the tool is aligned with the nozzle, to release a cleaning fluid through the nozzle for a first time-duration to clean the tool.

For the purposes of the present disclosure, expressions such as "including", "comprising", "incorporating", "consisting of", "have", "is" used to describe and claim the present disclosure are intended to be construed in a non-exclusive manner, namely allowing for items, components or elements not explicitly described also to be present. Reference to the singular is also to be construed to relate to the plural. Further, all joinder references (e.g., attached, affixed, coupled, connected, and the like) are only used to aid the reader's understanding of the present disclosure, and may not create limitations, particularly as to the position, orientation, or use of the systems and/or methods disclosed herein. Therefore, joinder references, if any, are to be construed broadly. Moreover, such joinder references do not necessarily infer that two elements are directly connected to each other.

The foregoing description of embodiments and examples has been presented for purposes of illustration and description. It is not intended to be exhaustive or limiting to the forms described. Numerous modifications are possible considering the above teachings. Some of those modifications have been discussed and others will be understood by those skilled in the art. The embodiments were chosen and described for illustration of various embodiments. The scope is, of course, not limited to the examples or embodiments set forth herein but can be employed in any number of applications and equivalent devices by those of ordinary skill in the art. Rather it is hereby intended the scope be defined by the claims appended hereto. Additionally, the features of various implementing embodiments may be combined to form further embodiments.

The present disclosure may be realized in hardware, or a combination of hardware and software. The present disclosure may be realized in a centralized fashion, in at least one computer system, or in a distributed fashion, where different elements may be spread across several interconnected computer systems. A computer system or other apparatus adapted for carrying out the methods described herein may be suited. A combination of hardware and software may be a general-purpose computer system with a computer program that, when loaded and executed, may control the computer system such that it carries out the methods described herein. The present disclosure may be realized in hardware that comprises a portion of an integrated circuit that also performs other functions. It may be understood that, depending on the embodiment, some of the steps described above may be eliminated, while other additional steps may be added, and the sequence of steps may be changed.

The present disclosure may also be embedded in a computer program product, which comprises all the features that enable the implementation of the methods described herein, and which when loaded in a computer system is able to carry out these methods. Computer program, in the present context, means any expression, in any language, code or notation, of a set of instructions intended to cause a system with an information processing capability to perform a particular function either directly, or after either or both of the following: a) conversion to another language, code or notation; b) reproduction in a different material form. While the present disclosure has been described with reference to certain embodiments, it will be understood by those skilled in the art that various changes may be made, and equivalents may be substituted without departing from the scope of the present disclosure. In addition, many modifications may be made to adapt a particular situation or material to the teachings of the present disclosure without departing from its scope. Therefore, it is intended that the present disclosure not be limited to the particular embodiment disclosed, but that the present disclosure will include all embodiments that fall within the scope of the appended claims.

What is claimed is:

1. A cleaning system for cleaning a tool, comprising:

a support structure comprising a first base portion;

a nozzle disposed on the first base portion of the support structure;

an electronically-actuated fluid release mechanism coupled to the nozzle, the electronically-actuated fluid release mechanism configured to control starting and stopping of a cleaning fluid through the nozzle;

a robot with an end-effector, the end-effector configured to be coupled to the tool;

and circuitry communicatively coupled to the electronically-actuated fluid release mechanism and the robot, wherein the circuitry is configured to:

instruct the robot to start a preset operation of the tool and determine a count of a first set of operation cycles of the preset operation of the tool while the tool is coupled to the end-effector of the robot;

instruct the robot to stop the preset operation of the tool and align the tool with the nozzle based on a determination that the determined count is greater than or equal to a threshold number;

based on whether the tool is aligned with the nozzle, control the electronically-actuated fluid release mechanism to start a release of the cleaning fluid through the nozzle for a first time-duration to clean the tool;

after the cleaning fluid is released for the first time-duration, instruct the robot to place the tool in a default position; and instruct the robot to resume the preset operation of the tool for a next set of operation cycles based on a determination that the tool is placed in the default position.

2. The cleaning system according to claim 1, wherein after the cleaning fluid is released for the first time-duration, the circuitry is further configured to control the electronically-actuated fluid release mechanism to stop the release of the cleaning fluid through the nozzle.

3. The cleaning system according to claim 1, further comprising a counter that is configured to store the determined count of operation cycles of the tool, wherein the circuitry is further configured to reset the counter to a default count value after the cleaning fluid is released for the first time-duration.

4. The cleaning system according to claim 1, wherein the release of the cleaning fluid causes a removal of debris accumulated in an interior portion of the tool.

5. The cleaning system according to claim 1, wherein the circuitry is communicatively coupled to a Human-Machine Interface (HMI) and is configured to:

receive a user input through the HMI, and based on the received user input, instruct the robot to:

stop the preset operation of the tool; and align the tool with the nozzle; and based on whether the tool is aligned with the nozzle, control the electronically-actuated fluid release mechanism to release the cleaning fluid through the nozzle for the first time-duration to clean the tool.

6. The cleaning system according to claim 1, wherein the cleaning fluid is one of: a compressed gas or a cleaning liquid.

7. The cleaning system according to claim 1, wherein the tool is a stud driver and the operation cycles of the tool correspond to tightening cycles.

8. The cleaning system according to claim 1, wherein the nozzle is a cylindrical structure comprising a plurality of holes disposed at least radially on the cylindrical structure, and each hole of the plurality of holes allows the nozzle to uniformly release the cleaning fluid for removal of debris accumulated in an interior portion of the tool.

9. The cleaning system according to claim 1, wherein the circuitry is further configured to:

instruct the robot to move the tool to engage with the nozzle while the tool is aligned with the nozzle; and further based on whether the nozzle is engaged with the tool, control the electronically-actuated fluid release mechanism to release the cleaning fluid through the nozzle for the first time-duration.

10. The cleaning system according to claim 1, wherein:

the support structure further comprises a second base portion and a pillar extending between the first base portion and the second base portion, and the support structure is shaped to have an I-shaped profile or H-shaped profile to provide a stability to the cleaning system.

11. The cleaning system according to claim 1, wherein the first base portion comprises at least one slot that is configured to receive a conduit comprising a first end and a second end, wherein the first end of the conduit is configured to be coupled to a mouth of the nozzle and the second end of the conduit is configured to be coupled to a port of the electronically-actuated fluid release mechanism.

12. The cleaning system according to claim 1, wherein the nozzle is vertically disposed on the first base portion.

13. The cleaning system according to claim 1, further comprising an electronically-controlled driving mechanism coupled to the support structure, wherein:

the support structure is mounted on a guide rail, and the circuitry is further configured to control the electronically-controlled driving mechanism to move the support structure on the guide rail to reach a position that is directly below the tool to align the nozzle with the tool.

* * * * *